US010701967B1

(12) United States Patent
Grigoryan

(10) Patent No.: US 10,701,967 B1
(45) Date of Patent: Jul. 7, 2020

(54) STORAGE CONTAINER ASSEMBLY

(71) Applicant: Arkady Grigoryan, Tujunga, CA (US)

(72) Inventor: Arkady Grigoryan, Tujunga, CA (US)

( * ) Notice: Subject to any disclaimer, the term of this patent is extended or adjusted under 35 U.S.C. 154(b) by 0 days.

(21) Appl. No.: 16/282,536

(22) Filed: Feb. 22, 2019

(51) Int. Cl.
*A24F 15/18* (2006.01)

(52) U.S. Cl.
CPC ..... *A24F 15/18* (2013.01)

(58) Field of Classification Search
CPC ..... A24F 15/18; A24F 15/20; B65D 85/109; B65D 85/1081; B65D 5/6691; B65D 85/1045
USPC ..... 206/92, 85, 1.5, 528–540, 242–276, 86, 206/96; 229/101; 220/8, 554, 281, 324
See application file for complete search history.

(56) References Cited

U.S. PATENT DOCUMENTS 1,450,674 A * 4/1923 Marston ..... A45C 7/0031 220/8
1,504,357 A * 8/1924 Lebwohl ..... B65D 85/109 206/91
1,536,570 A * 5/1925 Denny ..... A24F 15/18 206/92
1,540,553 A * 6/1925 Graham ..... A24F 15/18 206/92
1,616,436 A * 2/1927 Bird ..... A24F 23/04 206/92
1,726,843 A * 9/1929 Kornsweet ..... A24F 15/18 206/92
1,840,664 A * 1/1932 Gerstheimer ..... A24F 15/18 206/246
2,041,548 A * 5/1936 Holtzman ..... B65D 85/109 206/92
2,049,680 A * 8/1936 Adams ..... B65D 5/6608 206/93
3,021,944 A * 2/1962 Moore ..... A24F 15/18 206/92
3,115,241 A * 12/1963 Ast ..... B65D 85/109 206/92
3,388,706 A * 6/1968 Muirheid ..... A24F 15/18 131/238
4,015,769 A * 4/1977 Erlich ..... B65D 5/6602 206/92
4,164,999 A * 8/1979 Tsukamoto ..... B65D 85/109 206/91
5,558,217 A * 9/1996 Focke ..... B65D 85/109 206/265
5,740,938 A * 4/1998 Hofmann ..... B65D 43/162 206/531
5,878,875 A * 3/1999 Leong ..... A24F 15/18 206/268
6,021,901 A * 2/2000 Wolfe ..... B65D 43/162 206/1.5
6,321,757 B1 * 11/2001 McCutcheon ..... A24F 15/18 131/231

(Continued)

*Primary Examiner* — Chun Hoi Cheung
(74) *Attorney, Agent, or Firm* — Law Office of Michael O'Brien; Michael O'Brien

(57) ABSTRACT

The present invention relates to a storage container assembly configured to prevent child tampering with contents therein. The storage container assembly includes a base container and a lid, rotationally joined to the base container. The present invention relates to an improved storage container assembly creating a reusable storage container, a rigid storage container, a non-flammable storage container and a storage container having an airtight seal between the base container and the lid.

9 Claims, 23 Drawing Sheets

(56) References Cited

U.S. PATENT DOCUMENTS

| | | | | |
|---|---|---|---|---|
| 6,709,684 | B2 * | 3/2004 | Loth | B65D 25/107 206/37 |
| 6,832,686 | B2 * | 12/2004 | Donegan | B65D 77/02 206/1.5 |
| D545,493 | S * | 6/2007 | Carter | D27/189 |
| 7,549,541 | B2 * | 6/2009 | Brozell | B65D 83/0463 206/531 |
| 8,162,144 | B2 * | 4/2012 | Intini | B65D 43/162 206/1.5 |
| D834,819 | S * | 12/2018 | Burek | D3/294 |
| 2003/0205487 | A1 * | 11/2003 | Lin | A24F 15/18 206/86 |

* cited by examiner

STORAGE CONTAINER ASSEMBLY

RELATED APPLICATION

Background

1. Field of the Invention

The present invention relates to a storage container assembly for storing new smoking articles, used smoking articles and associated accessories. The storage container assembly configured to prevent child tampering with contents therein.

2. Description of Related Art

Cigarette and smoking article storage means such as cartons, boxes, cases, packs and containers are still commonly used today to store new cigarettes and smoking articles when not being smoked by the user. Commonly these storage means are non-rigid and are made of paper-based materials lacking rigidity. Problems arise when a smoking article is only partially smoked, and the user has the decision to save the smoking article for later use or discard of the smoking article. Currently, if the user attempts to store a smoking article for later use the smoking article is often still lit and can pose a potential risk of fire in inserted back into paper-based material storage means. Secondly, odor from the used smoking article is often unwanted in indoor, public or confined spaces. Lastly, security of smoking articles often held as a priority of the user of the smoking article, especially when securing and blocking access the smoking article to under-aged children. Additionally, when a container does not lock into a closed position, items stored inside are free to fall out if not secured properly. A solution is needs for smoking article storage means that create an airtight seal trapping odor within the storage means, constructed of a non-paper material for righty and safety and a secure method for storing a used smoking article for later use.

SUMMARY

The present invention relates to an improved storage container assembly creating an airtight seal. The airtight seal eliminates common odors from the used smoking article that is often unwanted in indoor, public or confined spaces. The storage container assembly comprises a lid member and a base member, wherein the connection between the lid member and the base member is tamper proof and creates a connection not easily opened by under-aged children.

An object of the present invention is to provide a reusable and rigid case in comparison to traditional paper-based storage containers wherein having paper material provides no rigidity or protection and poses a fire hazard to the user if a used cigarette is re-inserted into the container. The present invention aims to provide a safe storage medium for used smoking articles, even when still partially lit.

In order to do so a storage container assembly is provided. The storage container assembly configured to prevent child tampering with contents therein. The storage container assembly includes a base container and a lid, rotationally joined to the base container.

The base container having rear wall joined to a base container first side wall, a base container second side wall, and a base container bottom wall. Next, a base container front wall joined to the base container first side wall, the base container second side wall, and the base container bottom wall. The base container also having a first locking tab joined to the base container first side wall. The first locking tab extending above the base container front side wall and further comprising a first locking button. The base container also having a second locking tab joined to the base container second side wall. The second locking tab extending above the base container front side wall and further comprising a second locking button.

The storage container assembly therein creating a storage space existing between the base container rear wall, the base container front wall, the base container first side wall, the base container second side wall, and the base container bottom wall.

The storage container also including a lid member having a lid rear wall, joined to a first lid side wall, a second lid side wall and a lid top wall. The lid front wall is joined to the first lid side wall, the second lid side wall and the lid top wall. A first button opening arranged through the first lid side wall. Next, a second button opening arranged through the second lid side wall.

BRIEF DESCRIPTION OF THE FIGURES

The detailed description of some embodiments of the invention is made below with reference to the accompanying figures, wherein like numerals represent corresponding parts of the figures.

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

DETAILED DESCRIPTION OF CERTAIN EMBODIMENTS

Figure 1:
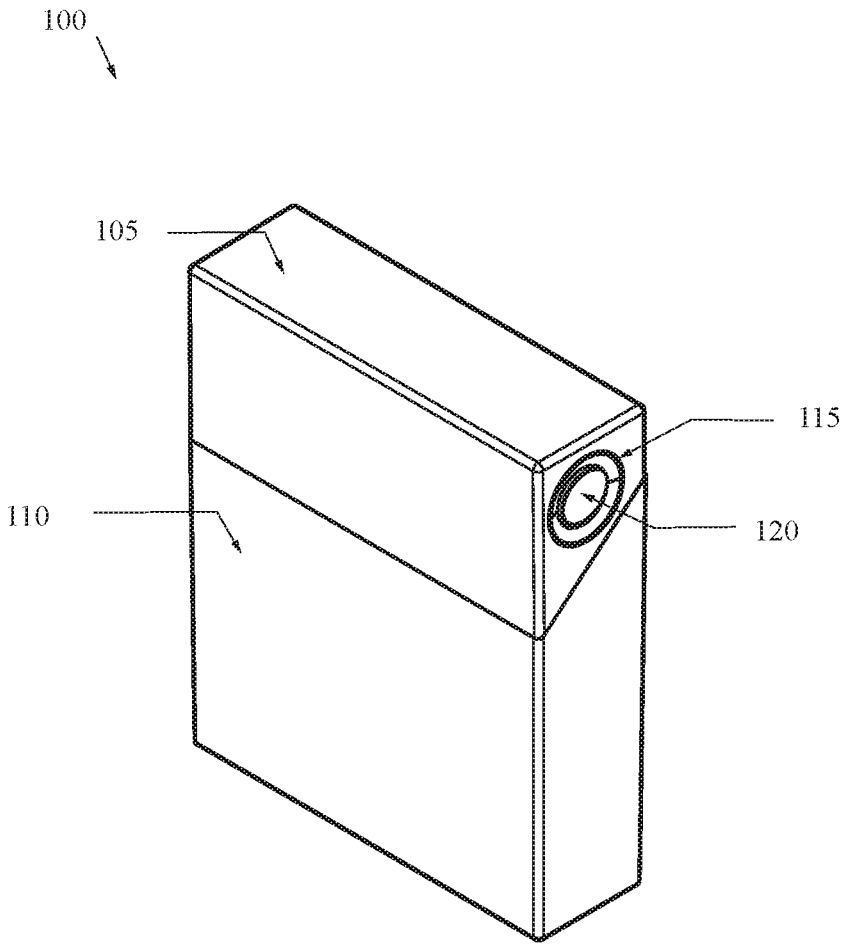
FIG. 1 shows an exemplary perspective view of one embodiment of the storage container assembly.
Figure 2:
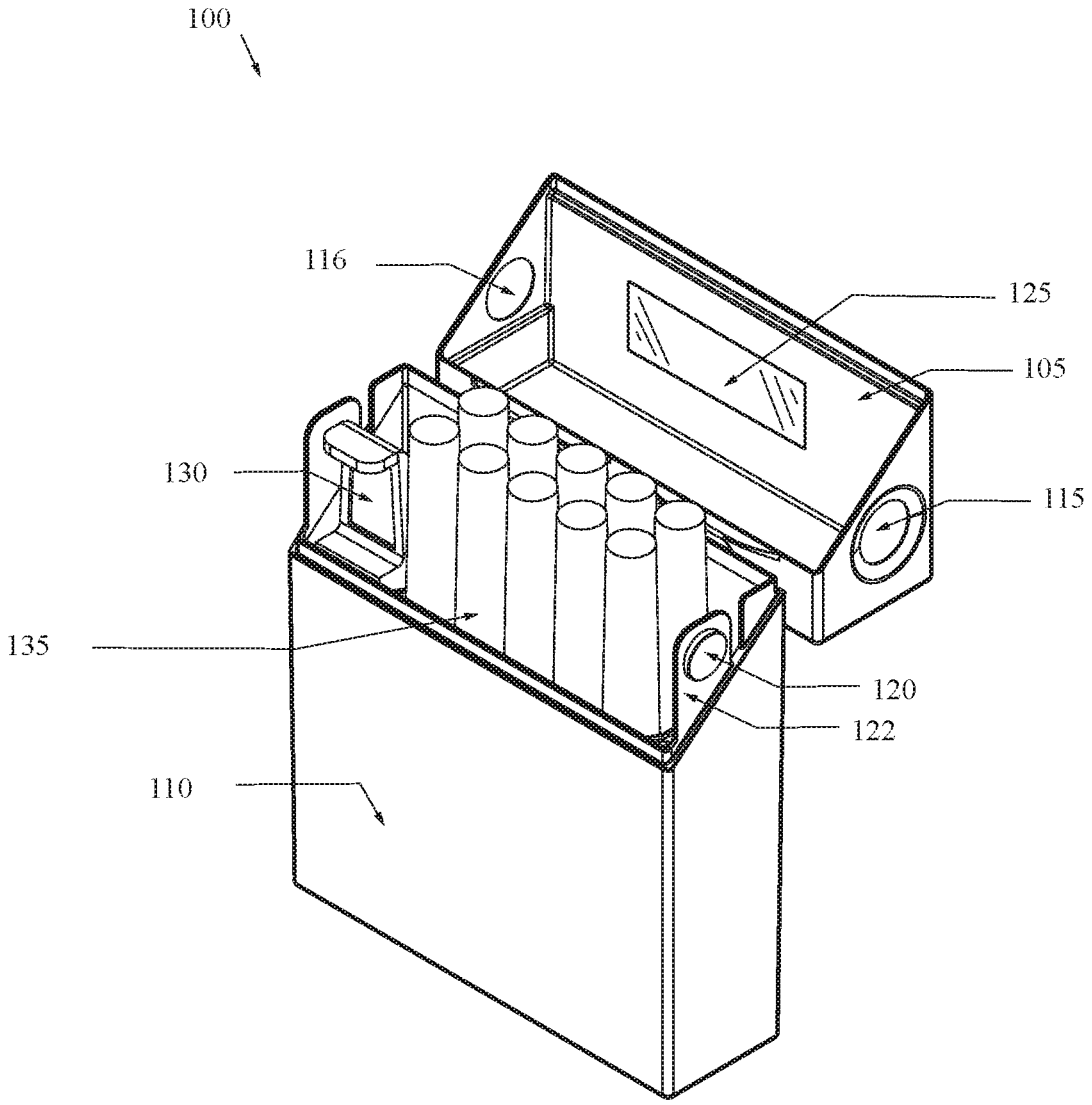
FIG. 2 shows an exemplary perspective view of one embodiment of the storage container assembly.
Figure 3:
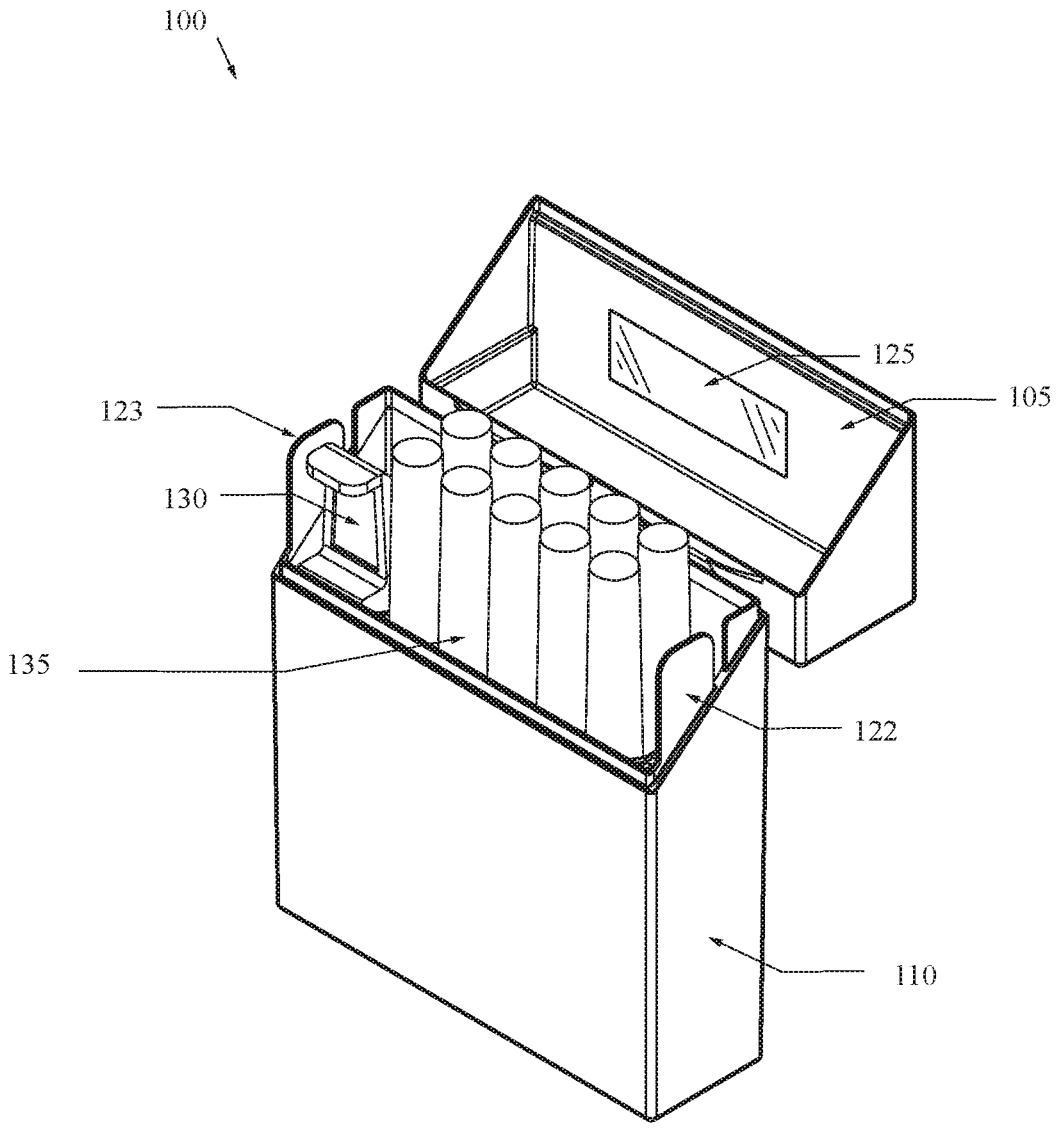
FIG. 3 shows an exemplary perspective view of one embodiment of the storage container assembly.

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

FIG. 1-21 illustrate an exemplary storage container assembly 100. The storage container assembly 100 configured to prevent child tampering with contents therein. The storage container assembly 100 includes a base container 110 and a lid 105, rotationally joined to the base container 110 by hinge 150.

The base container 110 having rear wall joined to a base container first side wall, a base container second side wall, and a base container bottom wall. Next, a base container front wall joined to the base container first side wall, the base container second side wall, and the base container bottom wall. The base container 110 also having a first locking tab 120 joined to the base container first side wall. The first locking tab extending above the base container front side wall and further comprising a first locking button 122. The base container 110 also having a second locking tab 121 joined to the base container second side wall. The second locking tab extending above the base container front side wall and further comprising a second locking button 123. The storage container assembly 100 therein creating a storage space existing between the base container rear wall, the base container front wall, the base container first side wall, the base container second side wall, and the base container bottom wall.

Figure 4:
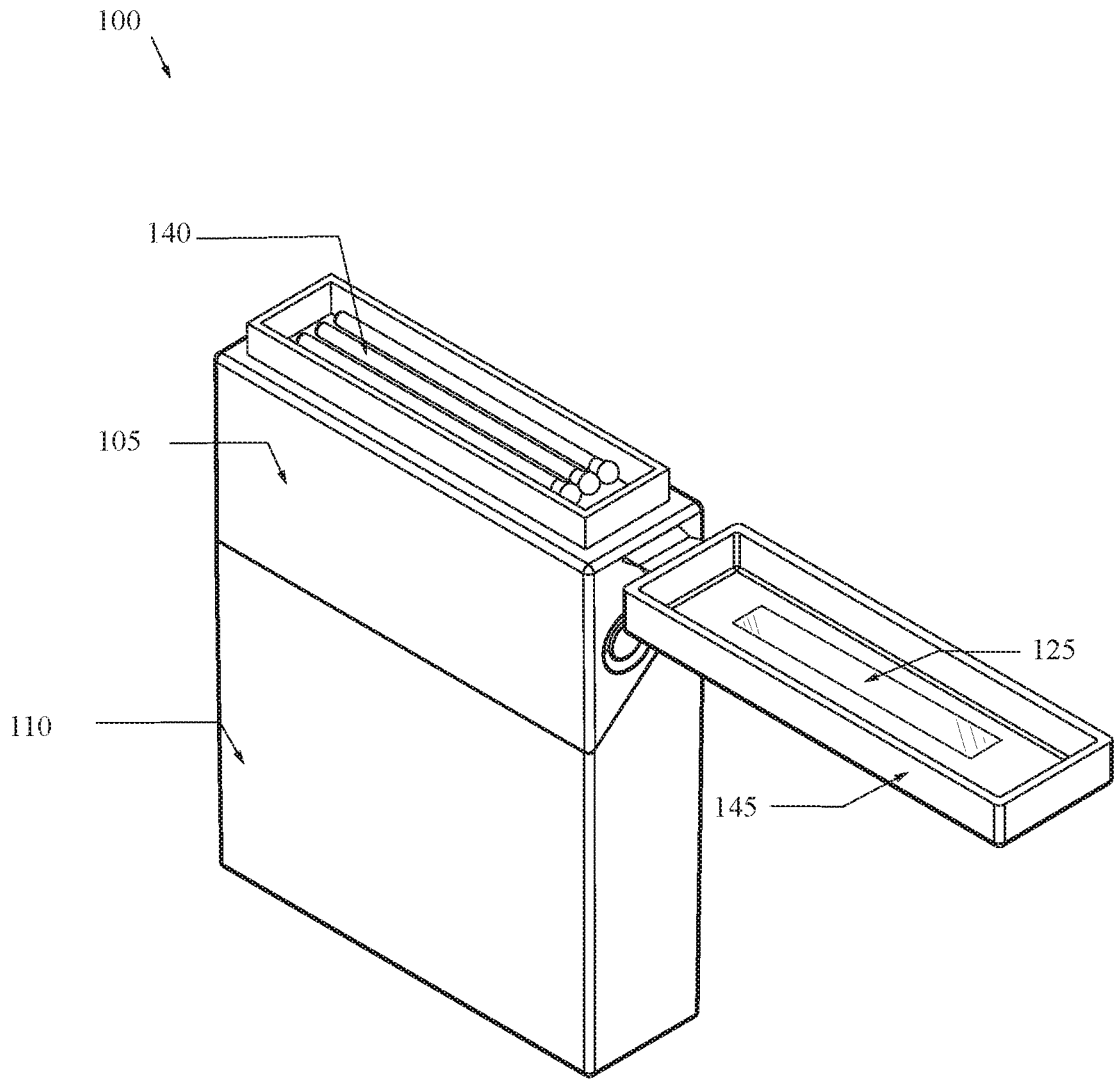
FIG. 4 shows an exemplary perspective view of one embodiment of the storage container assembly.
Figure 5:
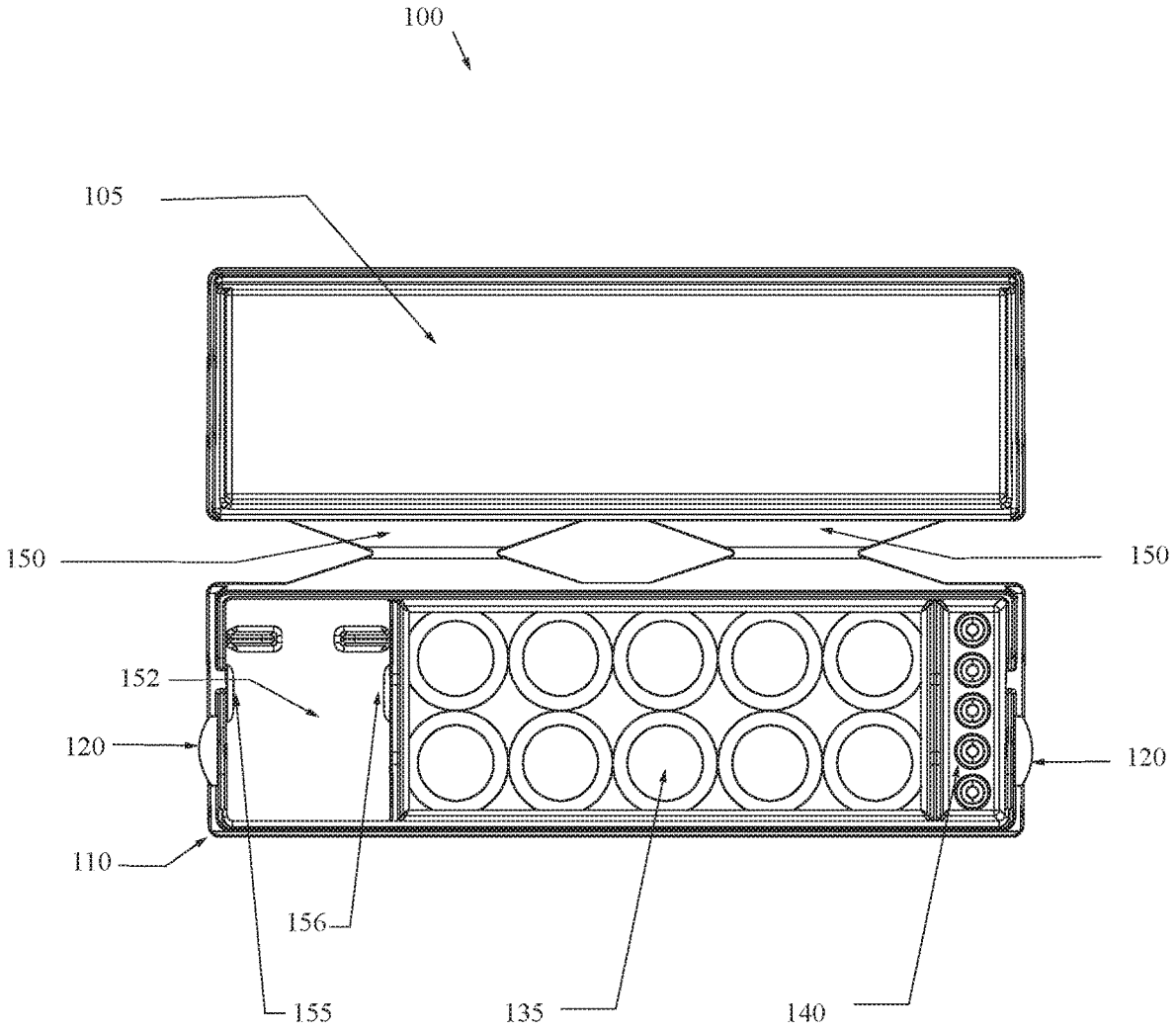
FIG. 5 shows an exemplary top view of one embodiment of the storage container assembly.
Figure 6:
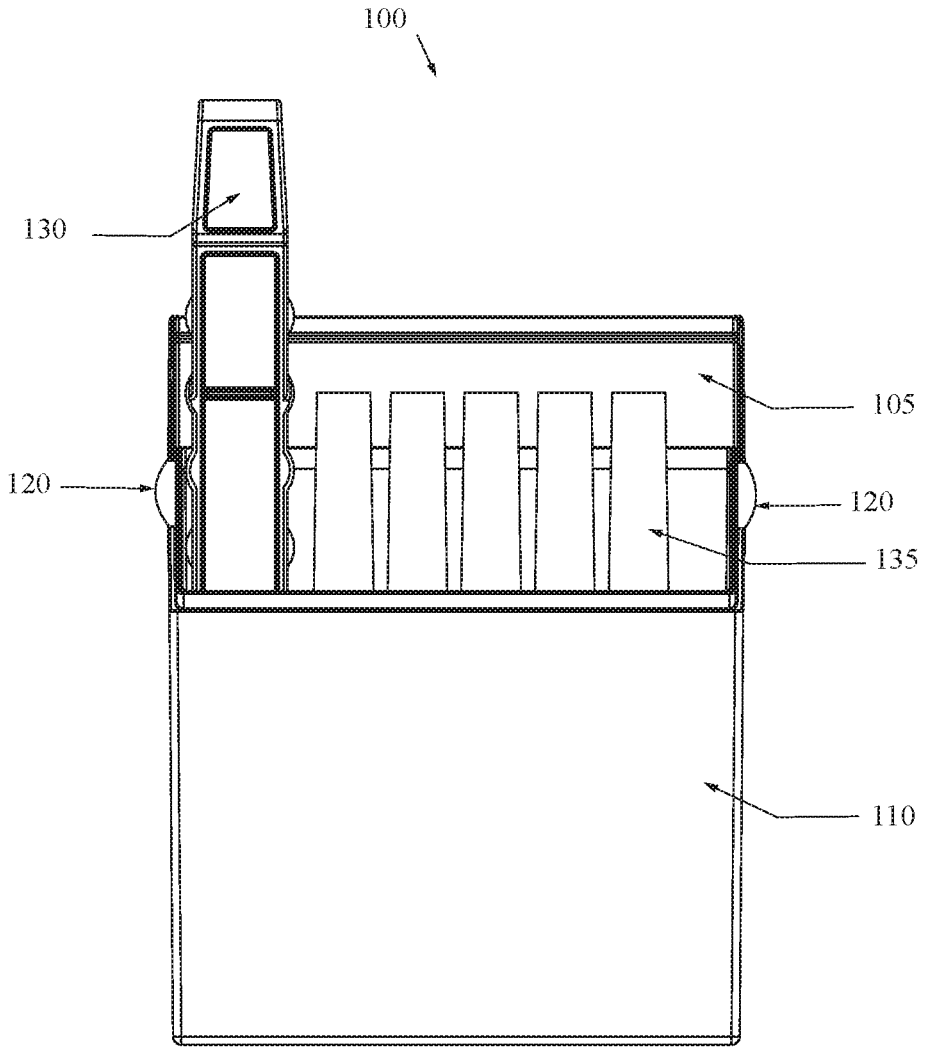
FIG. 6 shows an exemplary front view of one embodiment of the storage container assembly.
Figure 7:
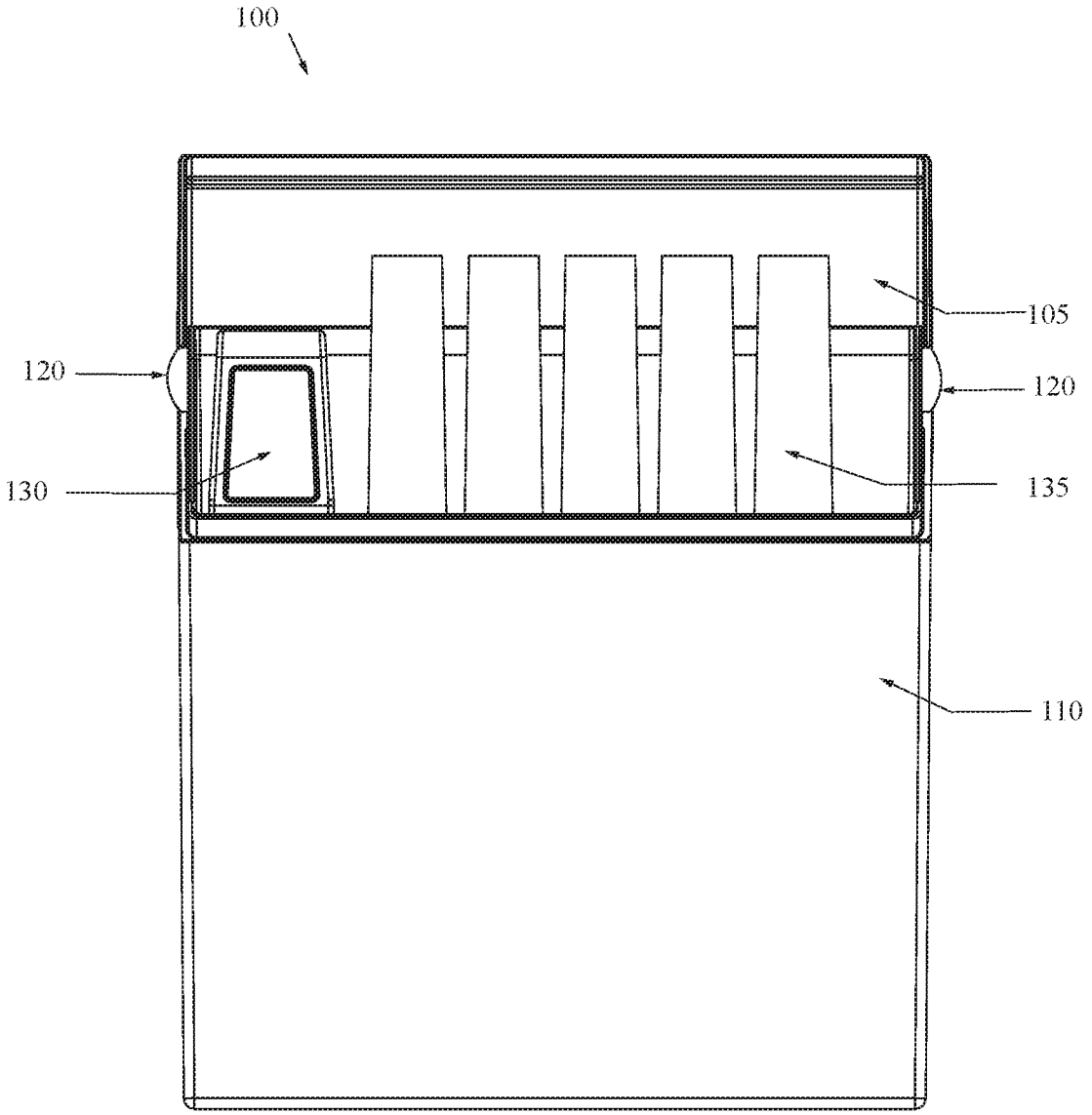
FIG. 7 shows an exemplary front view of one embodiment of the storage container assembly.
Figure 12:
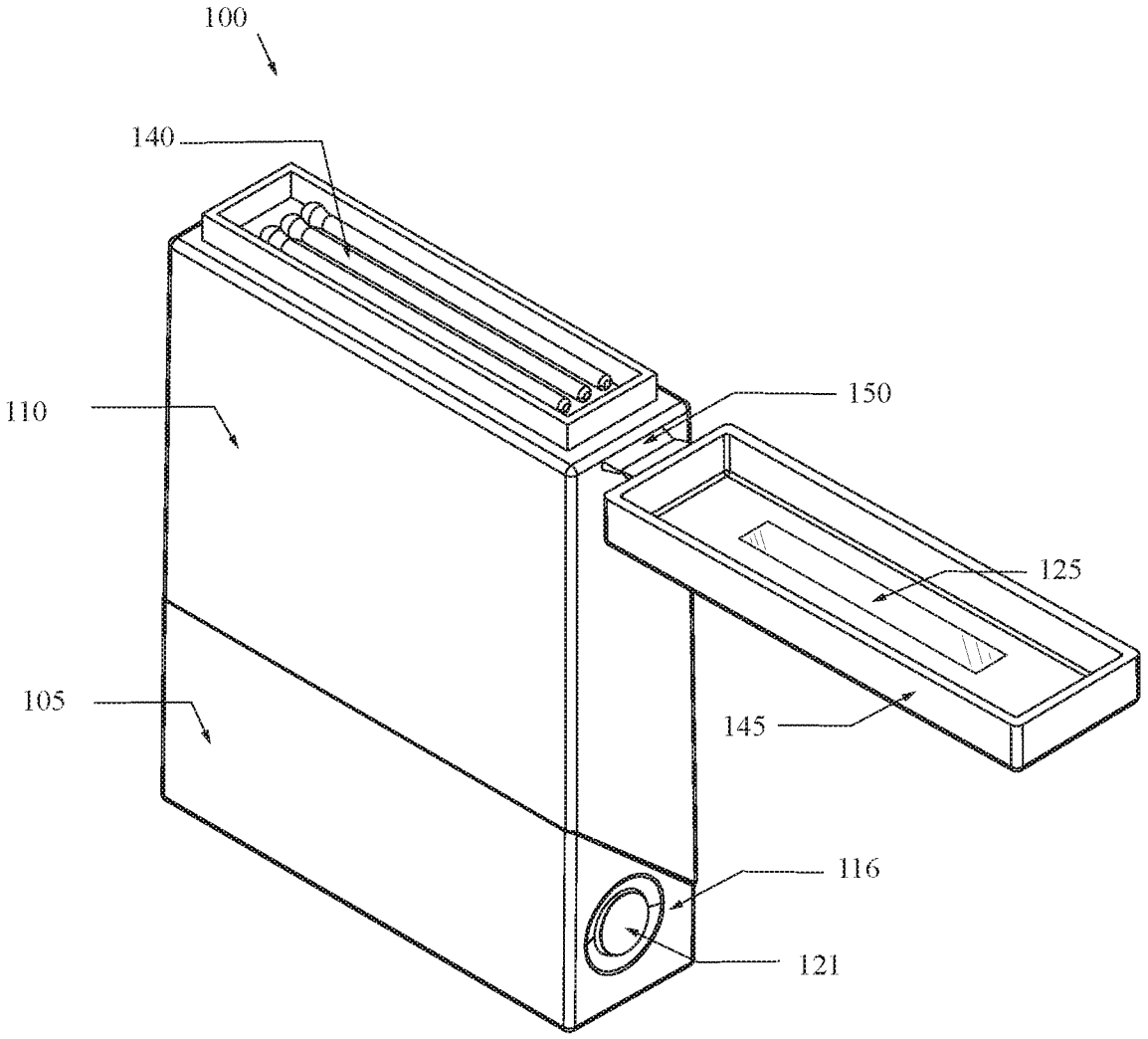
FIG. 12 shows an exemplary perspective view of one embodiment of the storage container assembly.

The storage container assembly 100 also including a lid 105 having a lid rear wall, joined to a first lid side wall, a second lid side wall and a lid top wall. The lid front wall is joined to the first lid side wall, the second lid side wall and the lid top wall. A first button opening 115 arranged through the first lid side wall. Next, a second button opening 116 arranged through the second lid side wall. In some embodiments, the lid 105 further comprises a match strikeplate 125. In some embodiments, the base container 110 further comprises a match strikeplate 125. In some embodiments, the lid 105 further comprises a match compartment 140 having a second lid 145 hingedly adjoined to the lid 105 by a hinge 150 (As shown in FIG. 4). In some embodiments, the base container 110 further comprises a match compartment 140 having a second lid 145 hingedly adjoined to the lid 105 by a hinge 150 (As shown in FIG. 12). In some embodiments, the match compartment 140 further comprises a match strikeplate 125. In some embodiments, the second lid 145 further comprises a match strikeplate 125.

In some embodiments, the storage container assembly further comprises a base container internal wall 151, joined to the base container front wall, the base container rear wall, and the base container bottom wall creating an internal container 152. In some embodiments, the internal wall 151 extends above the upper edge of the base container 110. In this exemplary embodiment, the base container internal wall 151 is approximately parallel to the base container first side wall and the base container second side wall. In some embodiments, the base container internal wall 151 is not parallel to the base container first side wall and the base container second side wall.

Figure 13:
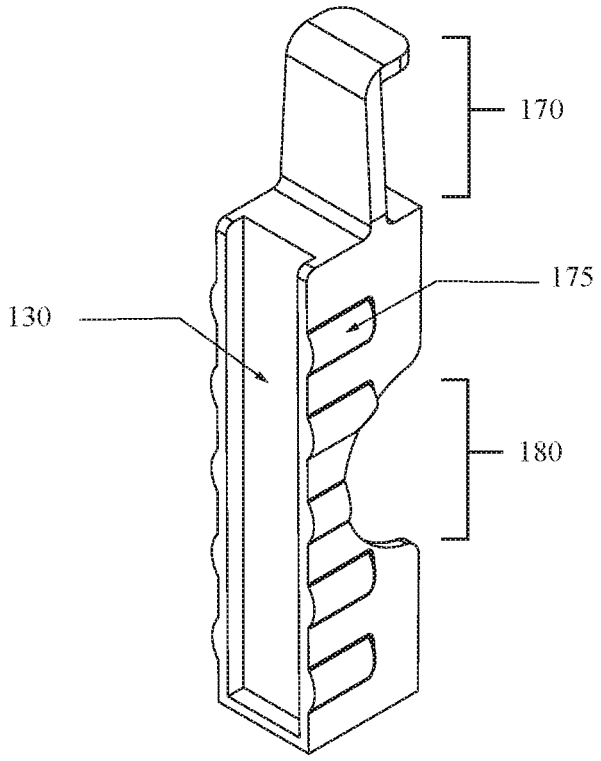
FIG. 13 shows an exemplary perspective view of one embodiment of the removable container of the storage container assembly.
Figure 14:
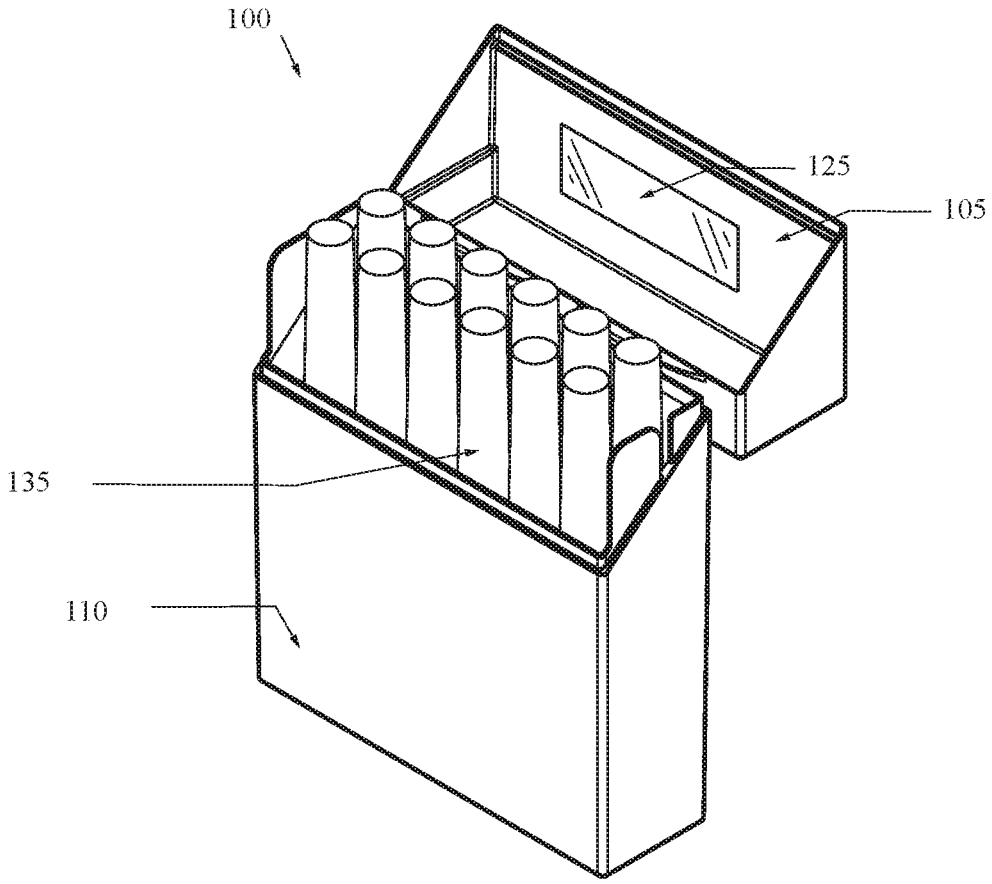
FIG. 14 shows an exemplary perspective view of one embodiment of the storage container assembly.
Figure 15:
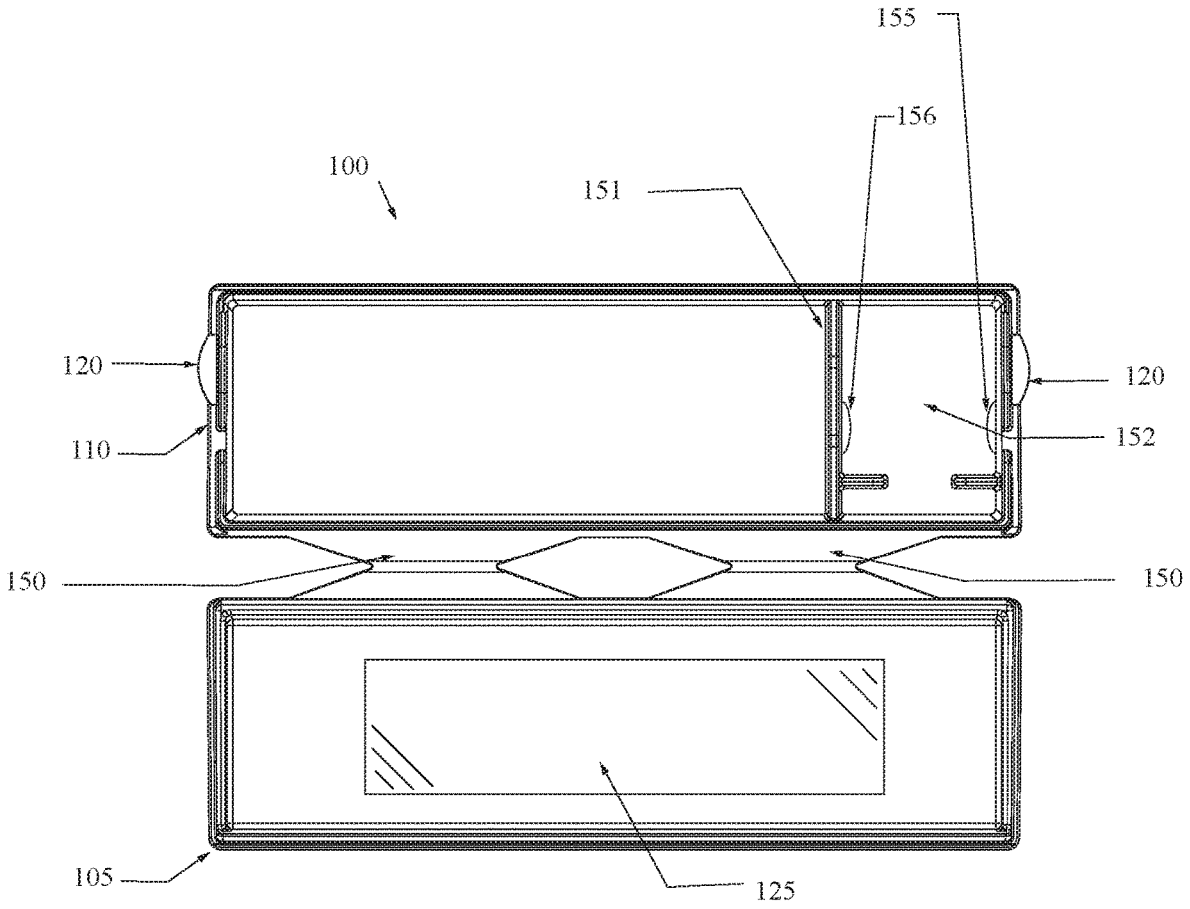
FIG. 15 shows an exemplary top view of one embodiment of the storage container assembly.
Figure 16:
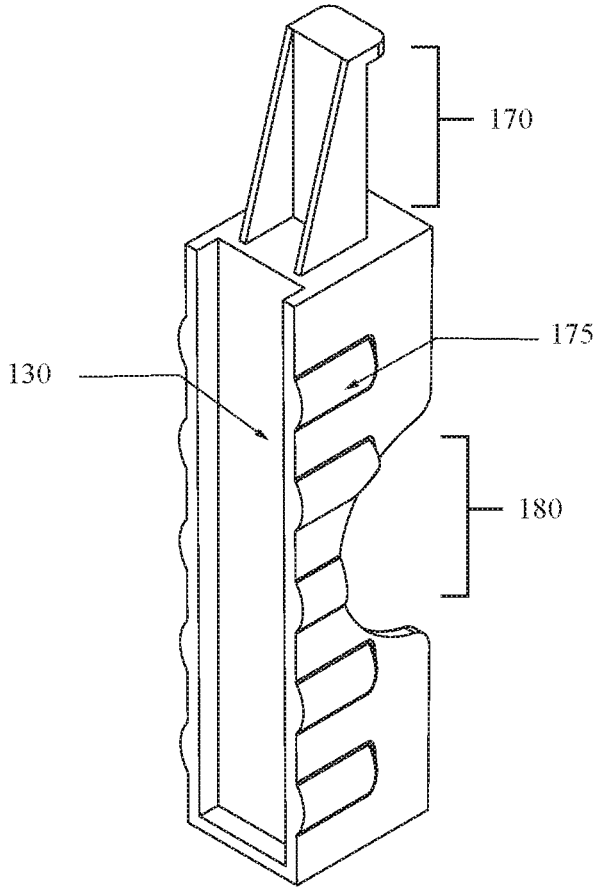
FIG. 16 shows an exemplary perspective view of one embodiment of the removable container of the storage container assembly.
Figure 17:
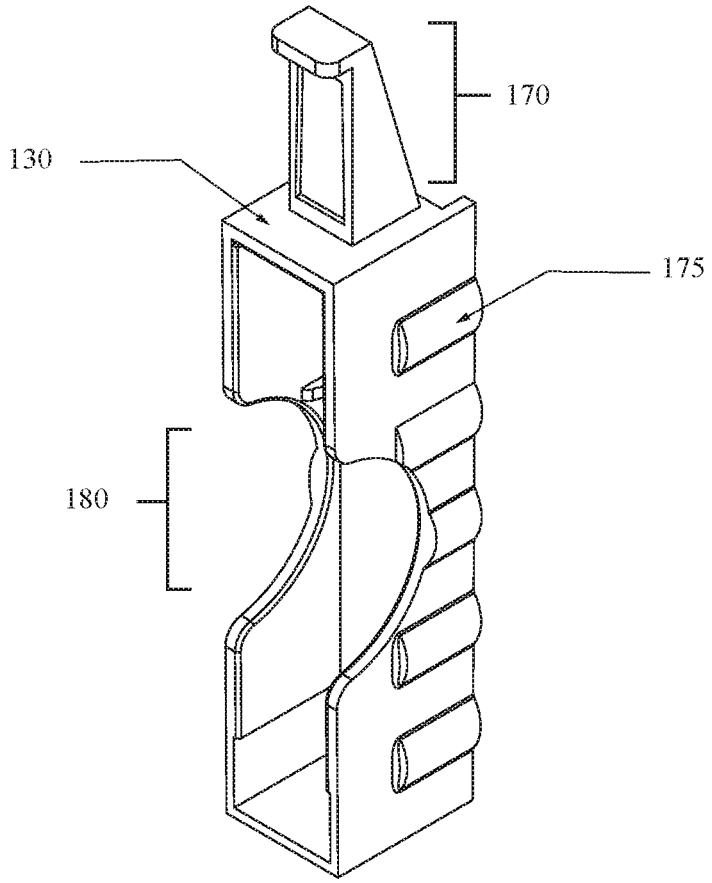
FIG. 17 shows an exemplary perspective view of one embodiment of the removable container of the storage container assembly.
Figure 18:
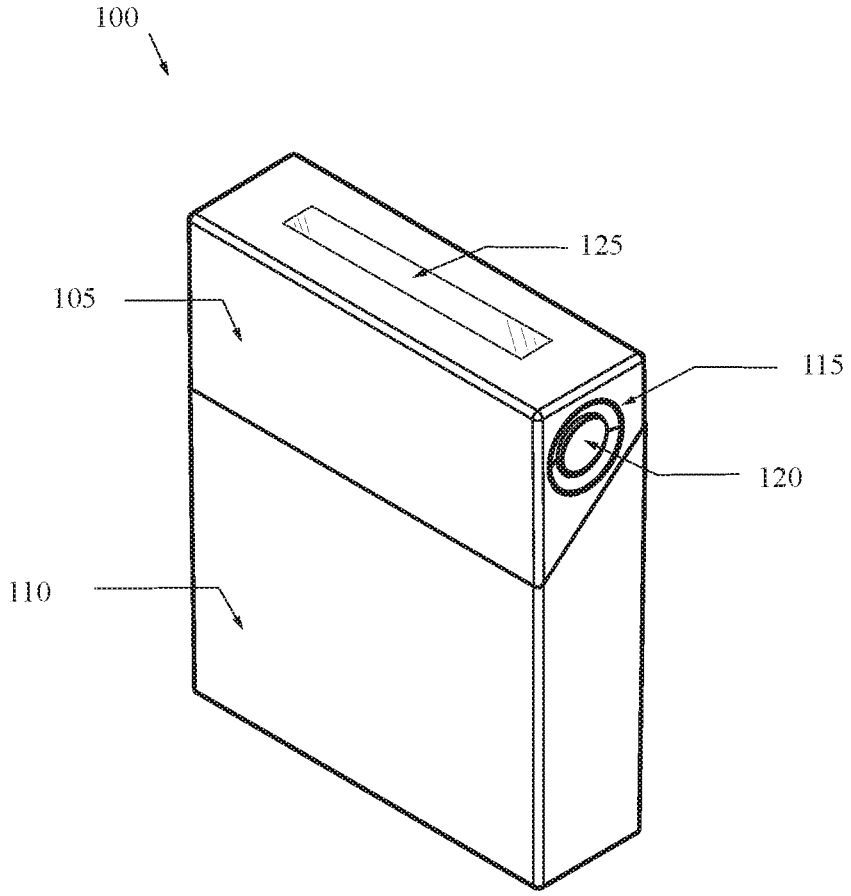
FIG. 18 shows an exemplary perspective view of one embodiment of the storage container assembly.
Figure 19:
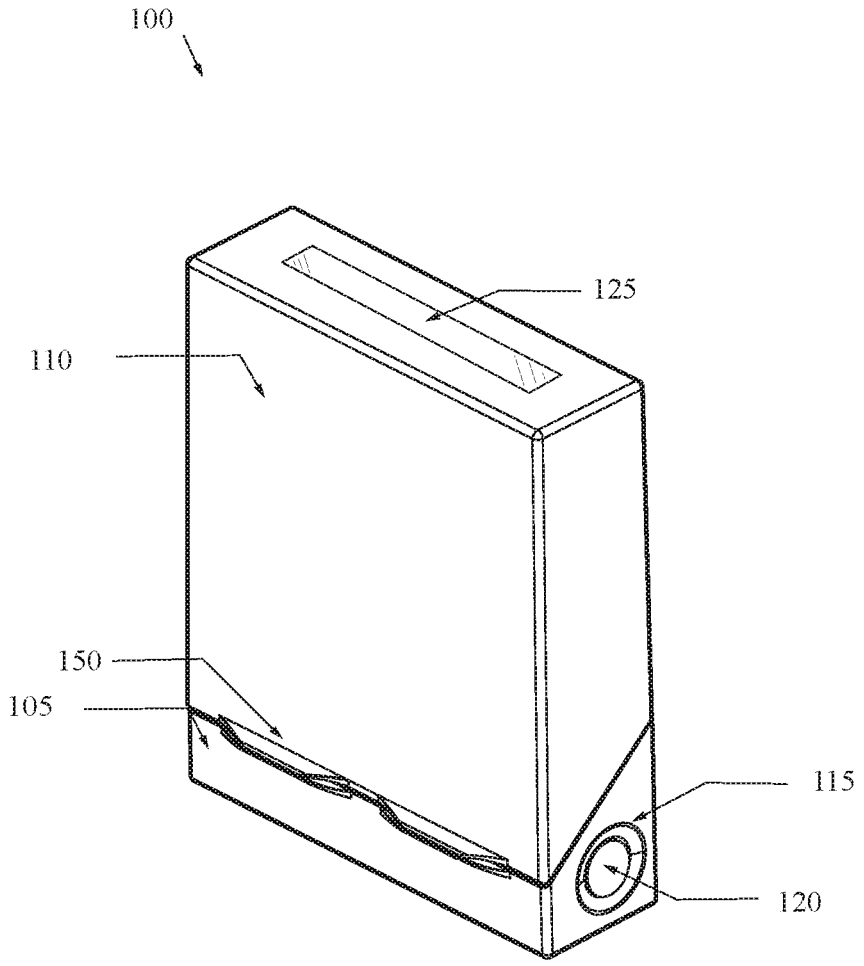
FIG. 19 shows an exemplary perspective view of one embodiment of the storage container assembly.
Figure 20:
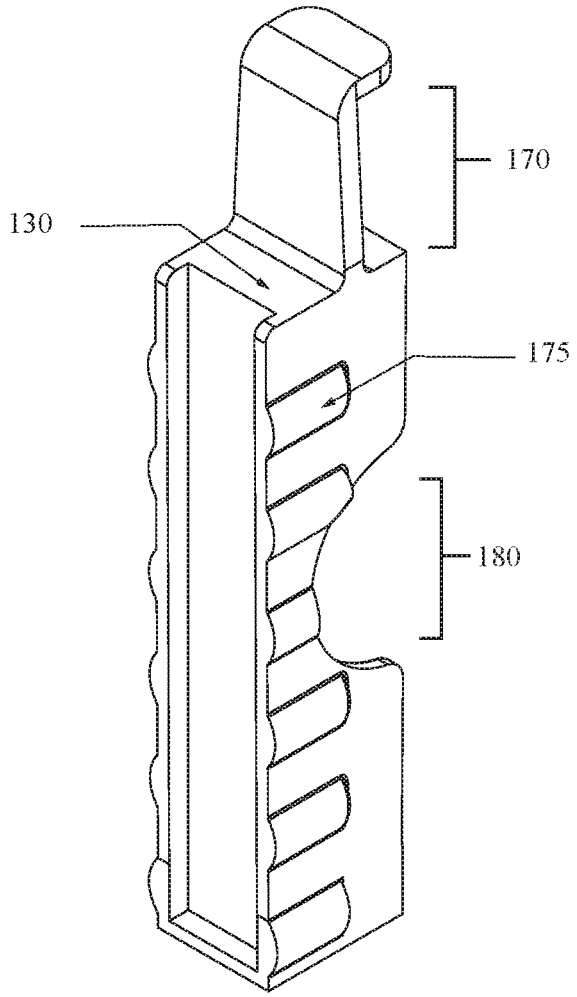
FIG. 20 shows an exemplary perspective view of one embodiment of the removable container of the storage container assembly.
Figure 21:
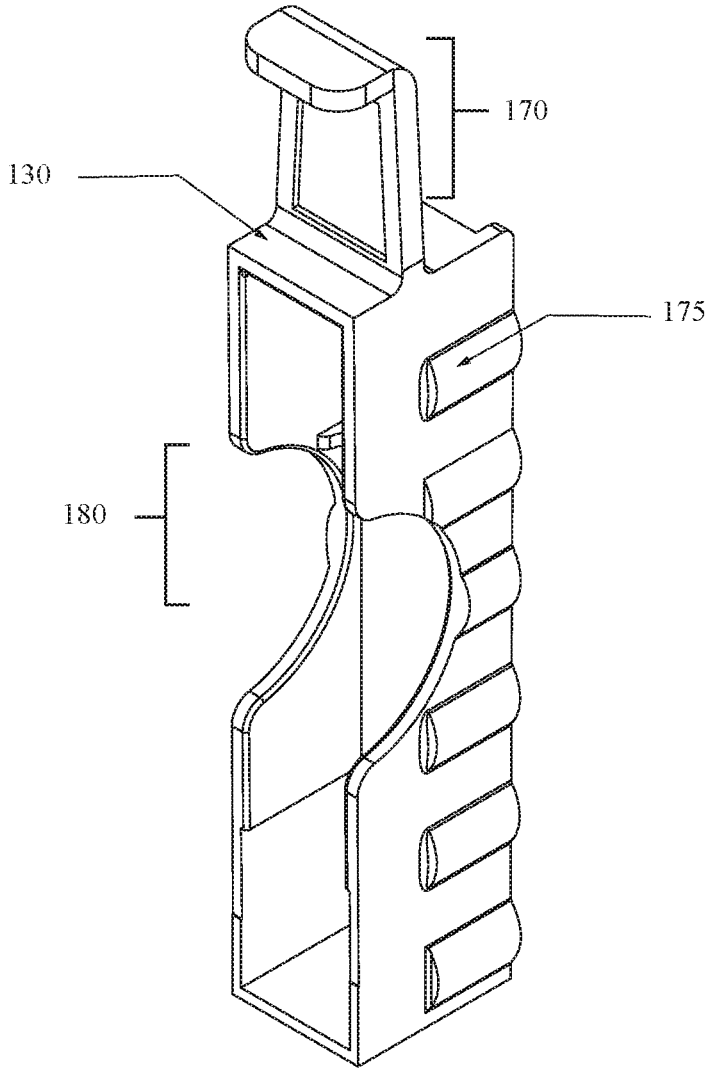
FIG. 21 shows an exemplary perspective view of one embodiment of the removable container of the storage container assembly.
Figure 22:
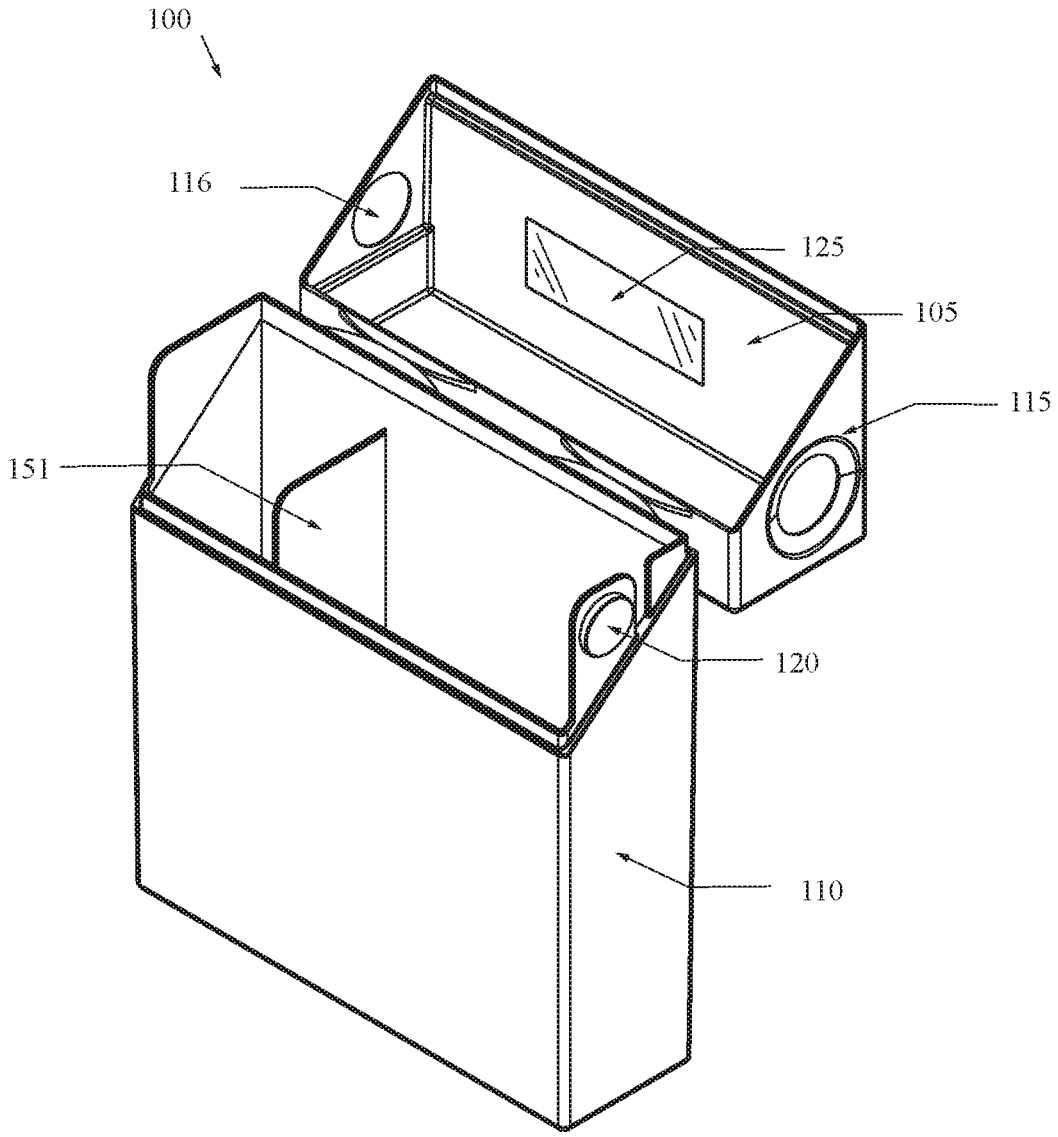
FIG. 22 shows an exemplary perspective view of one embodiment of the removable container of the storage container assembly.
Figure 23:
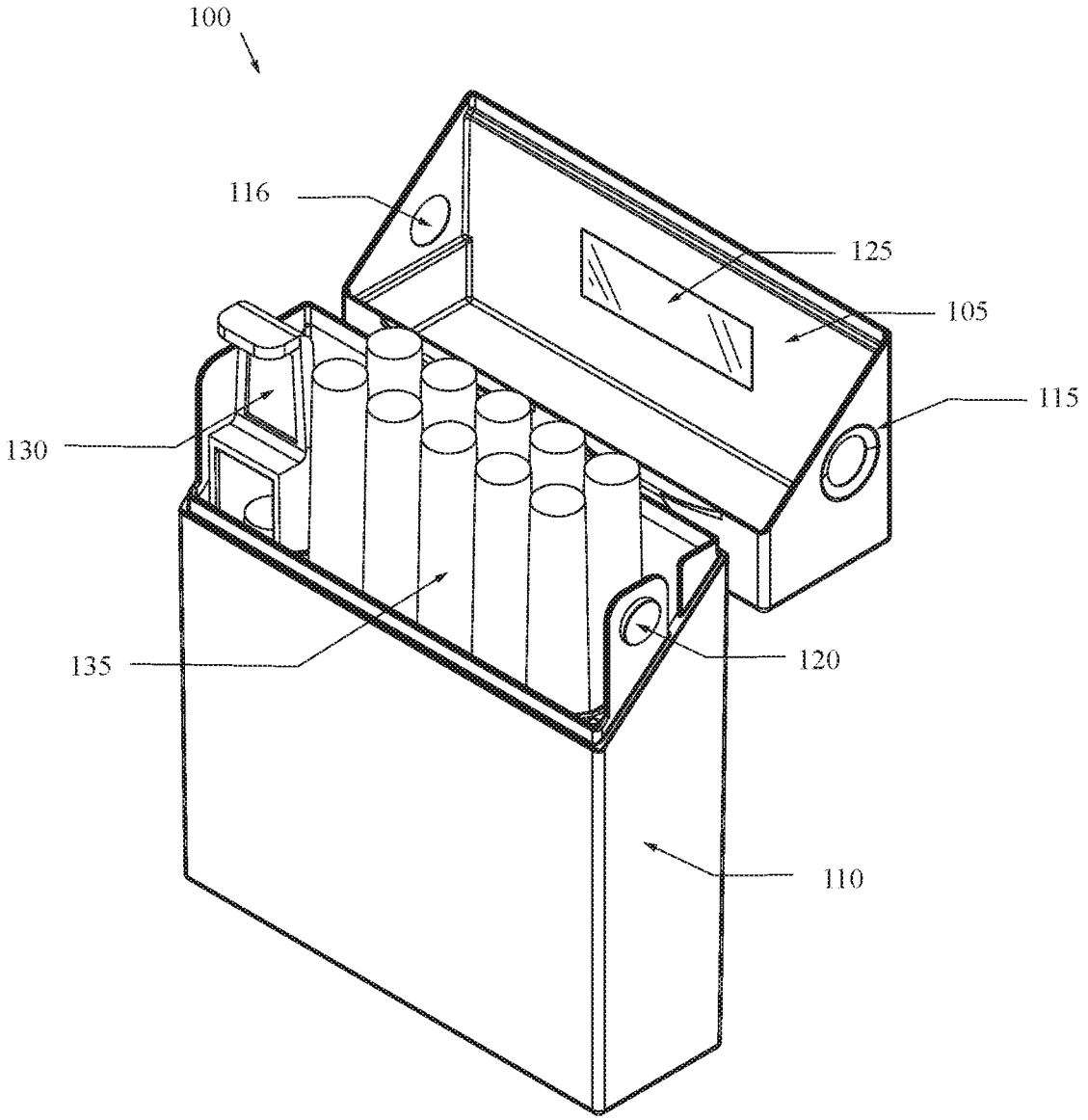
FIG. 23 shows an exemplary perspective view of one embodiment of the removable container of the storage container assembly.

In some embodiments, the base container internal wall 151 further comprises a plurality of internal wall protrusions 156 arranged within the internal container 152 on the base container internal wall 151 and a plurality of first wall protrusions 155 arranged within the internal container on the base container first side wall. Next, in some embodiments, a removable container 130 is inserted into the internal container and rests between the plurality of internal wall protrusions 156 and the plurality of first wall protrusions 155. In some embodiments, the removable container further comprises a plurality of bumps 175 arranged on the removable container, wherein the plurality of bumps rest between the plurality of internal wall protrusions and the plurality of first wall protrusions when the removable container in inserted within internal container. The removable container 130, in some embodiments, having a circular indentation 180 extending into the removable container. The circular indentation 180 allowing at least one finger of the user to remove a smoking article 135 held within the removable container 130. The removable container 130, in some embodiments, having a grip tab 170 extending away from the removable container. The grip tab allowing at least one finger of the user to remove the removable container 130 from the internal container 152. In some embodiments, the grip tab is the full width of the removable container 130 (as shown in FIGS. 13, 20 and 21). In some embodiments, the grip tab is the less than the full width of the removable container 130 (as shown in FIGS. 16 and 17).

The storage container assembly arranged to be used in different modes of operation. For example, in a first mode of operation the first locking button 122 extends through the first button opening 115 and the second locking button 123 extends through the second button opening locking the base container 110 to the lid 105 with an air tight seal.

For example, in a second mode of operation squeezing the first locking button 122 inward from the first button opening 115 while squeezing the second locking button 123 inward from the second button opening 116 unlocks the base container 110 from the lid 105 releasing the air tight seal. In some embodiments, the first locking button 122 and second locking button 123 are a convex shape. In some embodiments, the first locking button 122 and second locking button 123 are a concave shape. In some embodiments. the plurality of internal wall protrusions 156 and the plurality of first wall protrusions 155 are a convex shape. In some embodiments. the plurality of internal wall protrusions 156 and the plurality of first wall protrusions 155 are a concave shape.

Figure 8:
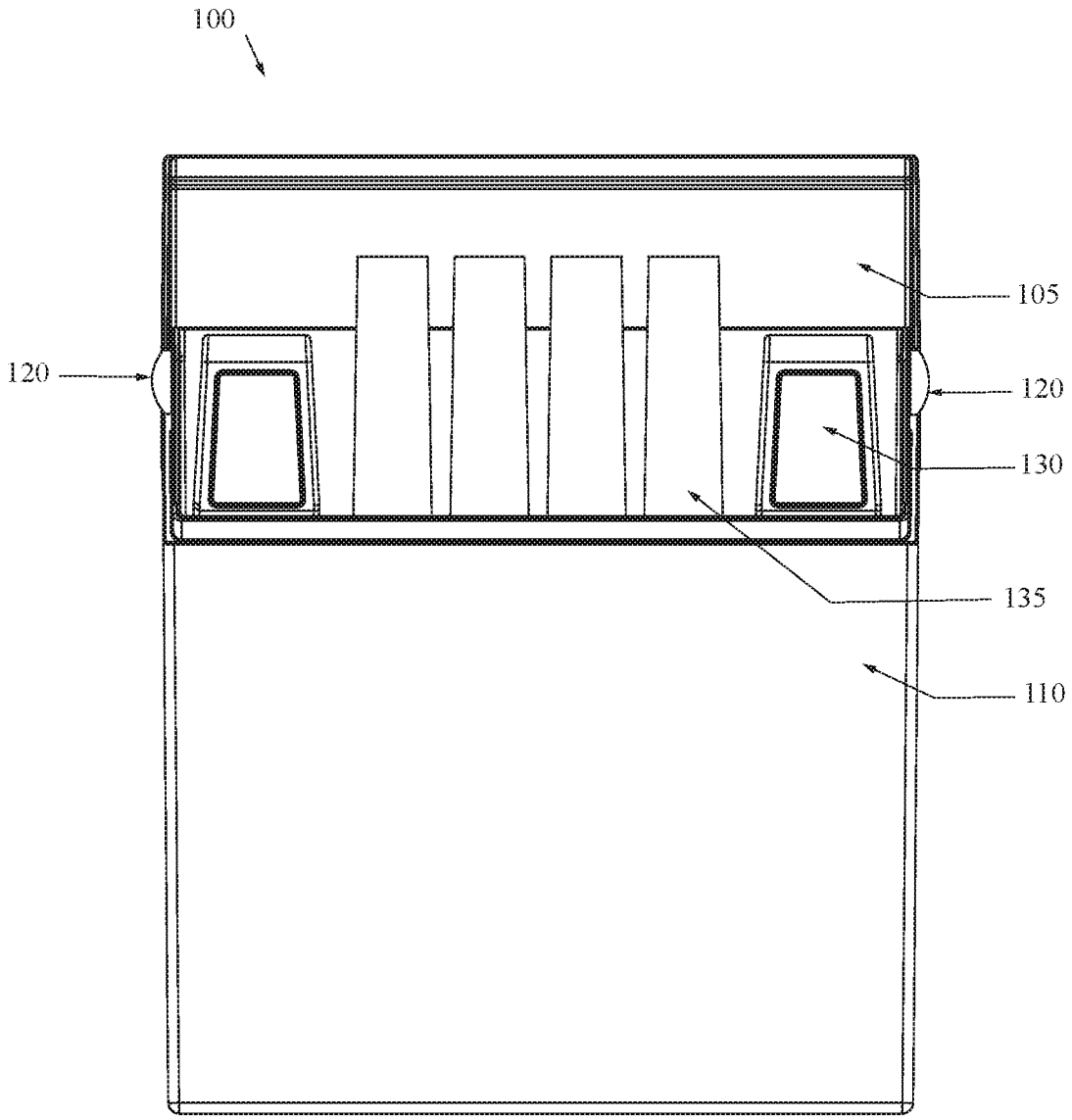
FIG. 8 shows an exemplary front view of one embodiment of the storage container assembly.
Figure 9:
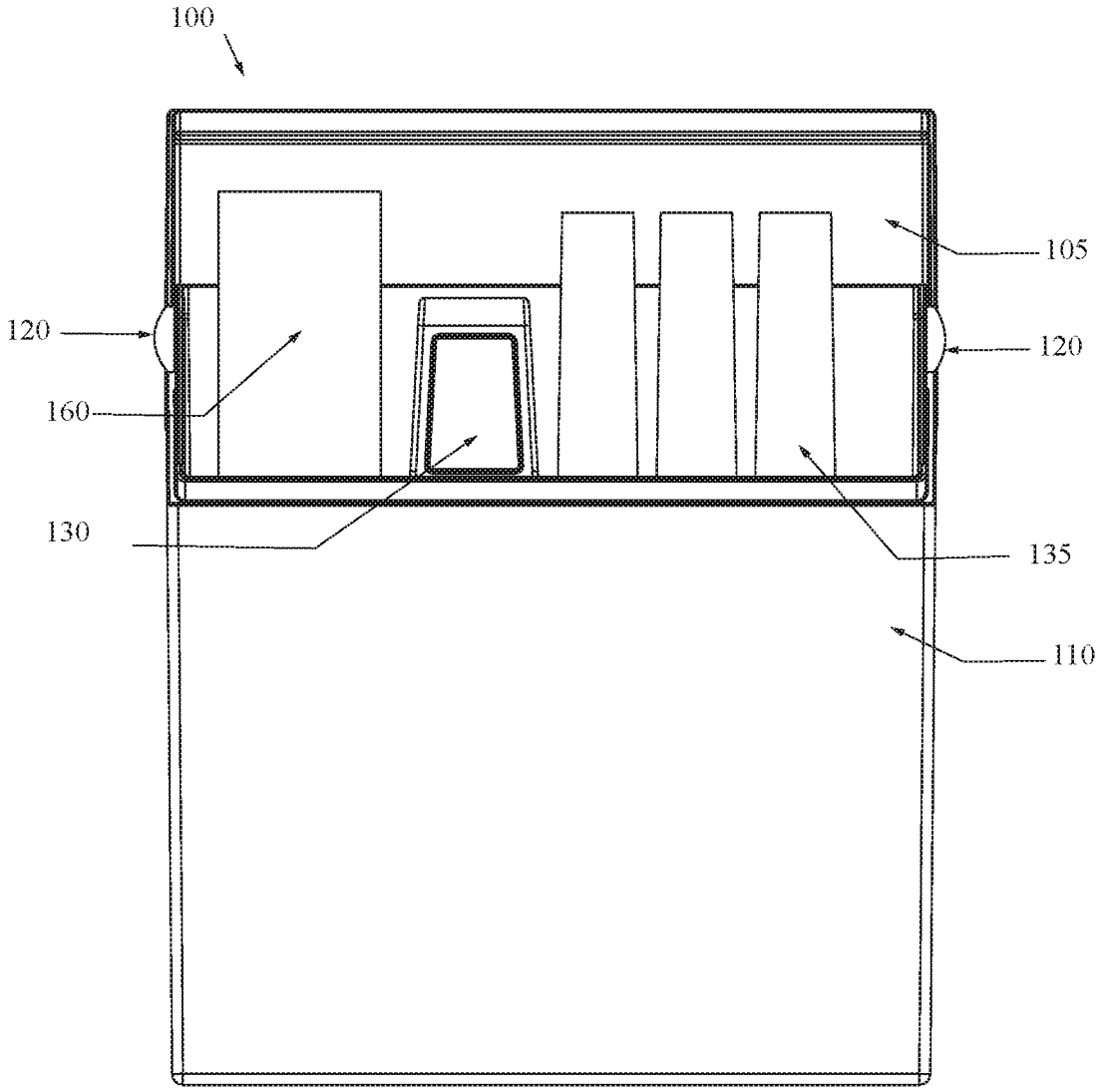
FIG. 9 shows an exemplary front view of one embodiment of the storage container assembly.
Figure 10:
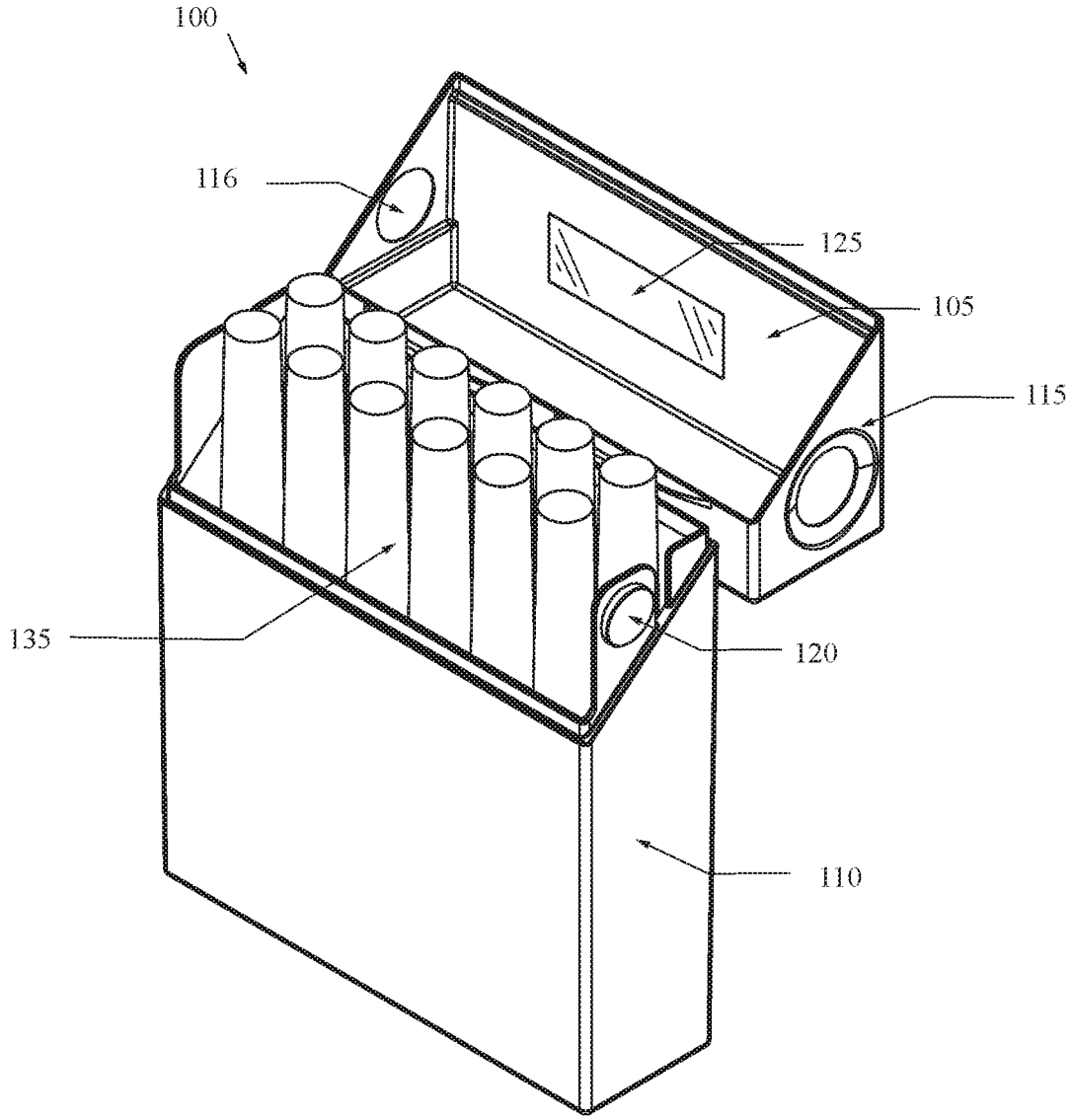
FIG. 10 shows an exemplary perspective view of one embodiment of the storage container assembly.
Figure 11:
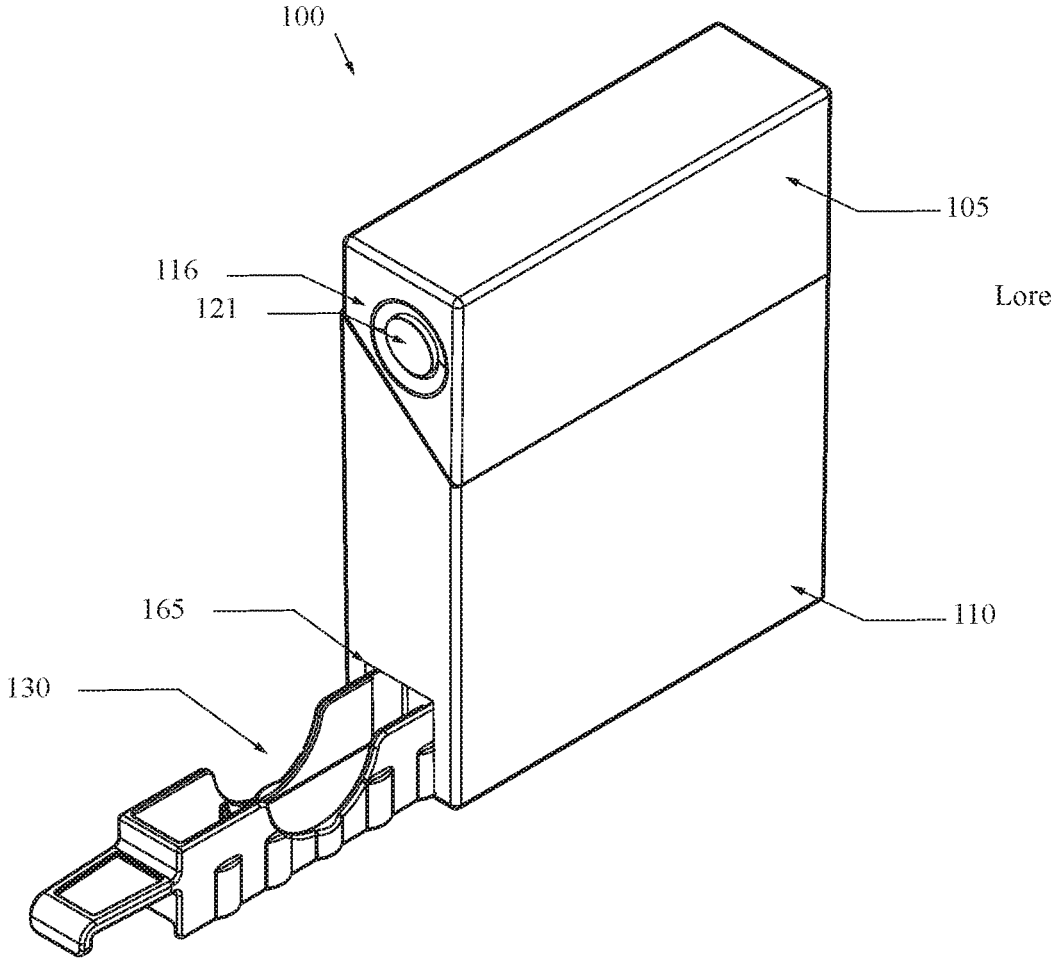
FIG. 11 shows an exemplary perspective view of one embodiment of the storage container assembly.

As shown in FIG. 11, in some embodiments, the removable container 130 may be inserted into the base container 110 through a removable container opening 165 arranged on the base container first side wall or the base container second side wall. In some embodiments, the base member 110 can include more than one base container internal wall 151 and more than one internal container 152. In some embodiments, the storage container assembly 100 can include more than one removable container 130 (As shown in FIG. 8). In some embodiments, the storage container assembly 100 can include a lighter 160 designed to fit within the internal container 152 (As shown in FIG. 9).

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" refers to an amount that is near the stated amount by about 0%, 5%, or 10%, including increments therein.

Unless otherwise defined, all technical terms used herein have the same meaning as commonly understood by one of ordinary skill in the art to which this disclosure belongs.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An storage container assembly, configured to prevent child tampering with contents therein; the storage container assembly comprising:

a base container, further comprising:

a base container rear wall joined to a base container first side wall, a base container second side wall, and a base container bottom wall, and a base container front wall joined to the base container first side wall, the base container second side wall, and the base container bottom wall;

a first locking tab, joined to the base container first side wall, extending above the base container front wall and further comprising a first locking button;

a second locking tab, joined to the base container second side wall, extending above the base container front wall and further comprising a second locking button;

wherein a storage space exists between the base container rear wall, the base container front wall, the base container first side wall, the base container second side wall, and the base container bottom wall;

a lid, rotationally joined to the base container and further comprising:

a lid rear wall, joined to a first lid side wall, a second lid side wall and a lid top wall;

a lid front wall, joined to the first lid side wall, the second lid side wall and the lid top wall;

a first button opening arranged through the first lid side wall;

a second button opening arranged through the second lid side wall;

a base container internal wall, joined to the base container front wall, the base container rear wall, and the base container bottom wall creating an internal container; wherein the base container internal wall is approximately parallel to the base container first side wall and the base container second side wall;

a plurality of internal wall protrusions arranged within the internal container on the base container internal wall;

a plurality of first wall protrusions arranged within the internal container on the base container first side wall;

a removable container, inserted into the internal container between the plurality of internal wall protrusions and the plurality of first wall protrusions;

wherein a first mode of operation the first locking button extends through the first button opening and the second button extends through the second button opening locking the base container to the lid with an air tight seal;

wherein a second mode of operation squeezing the first locking button inward from the first button opening while squeezing the second button inward from the second button opening unlocks the base container from the lid releasing the air tight seal.

2. The storage container assembly of claim 1, wherein the removable container further comprises a plurality of bumps arranged on the removable container; wherein the plurality of bumps rest between the plurality of internal wall protrusions and the plurality of first wall protrusions when the removable container in inserted within the internal container.

3. The storage container assembly of claim 1, further comprising a circular indentation extending into the removable container.

4. The storage container assembly of claim 3, further comprising a grip tab extending away from the removable container.

5. The storage container assembly of claim 4, further comprising a grip tab lower portion attached to the grip tab arranged immediately adjacent to base container front wall.

6. The storage container assembly of claim 1, wherein the lid further comprises a match strikeplate.

7. The storage container assembly of claim 1, wherein the base container further comprises a match strikeplate.

8. The storage container assembly of claim 1, wherein the lid further comprises a match compartment having a second lid hingedly adjoined to the lid.

9. The storage container assembly of claim 1, wherein the first button has a button shape selected from a button shaped set consisting of: a concave button, a convex button, and a cylindrical button.

* * * * *